US009877561B2

(12) United States Patent
Syms

(10) Patent No.: US 9,877,561 B2
(45) Date of Patent: Jan. 30, 2018

(54) MULTIPLE CONFIGURATION STRING-LIKE ACCESSORY

(71) Applicant: Jacqueline Syms, Waccabuc, NY (US)

(72) Inventor: Jacqueline Syms, Waccabuc, NY (US)

( * ) Notice: Subject to any disclaimer, the term of this patent is extended or adjusted under 35 U.S.C. 154(b) by 21 days.

(21) Appl. No.: 14/455,870

(22) Filed: Aug. 8, 2014

(65) Prior Publication Data

US 2016/0037880 A1 Feb. 11, 2016

(51) Int. Cl.

| | |
|---|---|
| ***A44C 13/00*** | (2006.01) |
| ***A44C 15/00*** | (2006.01) |
| ***A45D 8/36*** | (2006.01) |
| ***A44B 17/00*** | (2006.01) |
| ***A44C 25/00*** | (2006.01) |

(52) U.S. Cl.

CPC ..... *A45D 8/36* (2013.01); *A44B 17/0058* (2013.01); *A44C 25/00* (2013.01)

(58) Field of Classification Search

CPC ..... A44C 5/2071; A44C 5/2076; A44C 25/00; A44C 13/30; A45D 8/36; A41D 27/08; A43B 3/122; A41F 15/002; A41C 3/12; Y10T 24/1406; Y10T 24/2164; Y10T 24/31; Y10T 24/318; Y10T 24/1402; A44B 17/0058

See application file for complete search history.

(56) References Cited

U.S. PATENT DOCUMENTS

| | | | | |
|---|---|---|---|---|
| 654,668 A * | 7/1900 | Pergande | ..... | B65D 63/1018 24/17 A |
| 2,870,502 A * | 1/1959 | Sasse | ..... | B60R 7/10 24/17 A |
| 2010/0285283 A1* | 11/2010 | Kingsbury | ..... | A42B 1/004 428/195.1 |

* cited by examiner

*Primary Examiner* — Jack W Lavinder
(74) *Attorney, Agent, or Firm* — Handal & Morofsky LLC

(57) ABSTRACT

A styling accessory is adapted to be configured into different configurations for performing different corresponding functions and comprises a band having a length and a width. The length is at least ten times the width. The band has first and second surfaces. The band is made of a material capable of being formed into a curved shape. A plurality of male snaps are disposed along a first portion of the length of the band. A plurality of female snaps are disposed along a second portion of the length of the band. The second portion is adjacent the first portion. The female snaps mate with the male snaps.

12 Claims, 11 Drawing Sheets

Figure 9
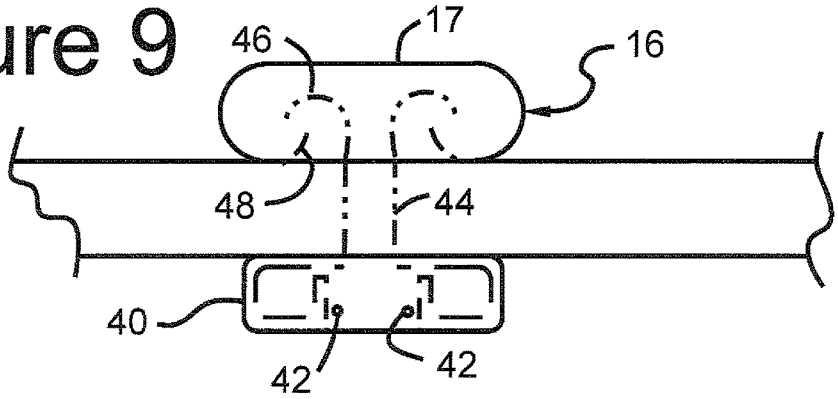
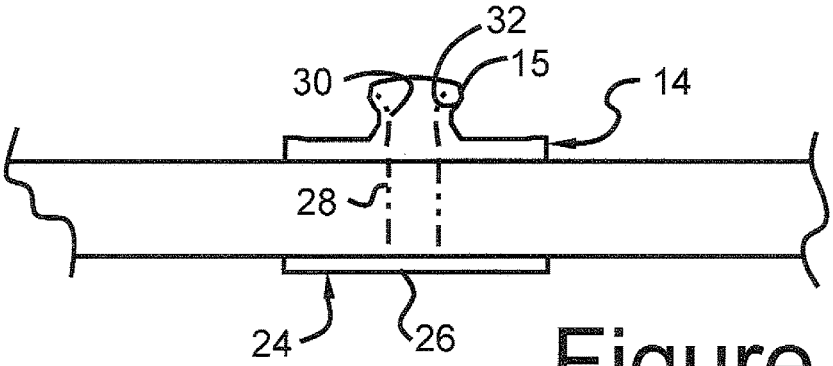
Figure 8

MULTIPLE CONFIGURATION STRING-LIKE ACCESSORY

TECHNICAL FIELD

The present invention relates to a fashion accessory referred to herein as a styling accessory styling that can be accommodated to different users and/or transformed to serve as a multifunctional adornment to enhance the image of the wearer.

CROSS REFERENCE TO RELATED APPLICATIONS

Not applicable.

STATEMENT REGARDING FEDERALLY SPONSORED RESEARCH OR DEVELOPMENT

Not applicable

BACKGROUND OF THE INVENTION

Today, there is an increasing awareness of style and the need to appear attractive, garner attention and elicit a favorable response from ones friends, associates at work and others that we may meet. The demands on a fashion accessory are substantial. They must appear dramatic (for one reason or another) and interesting. They are often at their best when they appear novel or unusual. However, at the same time, they must fit in with relatively rigid protocols dictated by past fashion, current trends, and a certain hard to particularize "sense of fashion." Thus, the development of fashion accessories that stand out and yet fit within the above parameters presents a substantial challenge to designers.

As a result, the number of successful introductions is very limited, and the number of tried and failed entrants represents a substantial cost to innovators. Thus, despite the necessity for innovative personal adornment to enhance the beauty of an individual, create a sense of status or create attraction, while at the same time being efficient on cost of the adornment, creates inherent and substantial conflicts and challenges. Moreover, costs of introduction must take into account, not only design costs, but also other new product costs, such as market education, advertising, tooling, sales costs and so forth.

SUMMARY OF THE INVENTION

In accordance with the invention, costs associated with the inventive new product may more effectively be utilized on a garment that is at once traditional and innovative, while allowing the user a large measure of self expression. Notwithstanding the facility for self-expression, the structural elements act as an anchor, at once assuring that user expression will remain in a range consistent with mechanical stability, accepted aesthetic limits and a quality look.

Moreover, the subject design, in addition to allowing a wide range of self expression, also is adapted to accommodate users within a large range of clothes sizes. Efficiencies in cost can be maximized with the inventive personal adornment that is manufactured with the facility of being able to be worn in a plurality of configurations and/or as different types of adornments. The inventive accessory, referred to herein as a styling accessory, can be used in different arrangements. More particularly, the inventive styling accessory can be arranged or configured in many different configurations, allowing personal creativity. Resulting arrangements may function as a bracelet, belt, headband or necklace.

Moreover, the structure of the inventive styling accessory is such that that the wearer of the strap-like accessory may choose to snap down essentially every snap that the wearer does not choose to leave free.

Snap shapes can be varied, as can their size and color. For example, the female decorative side can be any shape (i.e. pyramid shaped, cone shaped, heart shaped etc). Also, snaps can be employed in the invention in any material, such as plastic, wood, ceramic, bone, horn, any metal, or precious metal such as gold, silver, and platinum, etc.

In accordance with the invention, an accessory for personal adornment that transforms into a plurality of adornments each having a plurality of configurations is provided. The styling accessory can be transformed, for example into such accessories as a bracelet, a belt, a headband, and single and double strap necklaces.

The inventive accessory comprises a leather ribbon, which is, for example, one centimeter in width. Any material, and most preferably a flexible, bendable or formable material, may be used in place of leather.

The top surface of the inventive styling accessory may carry forty-two 42 snaps disposed its length, with equal, for example, numbers of female and male snaps. The leather may have a finished and unfinished side, with the male portion inserted through the leather ribbon exposing a, for example metallic, rounded knob on the finished or unfinished side of the ribbon. Female snaps are likewise disposed along the length of the leather ribbon.

A styling accessory is adapted to be configured into different configurations for performing different corresponding functions and comprises a band having a length and a width. The length is at least ten times the width. The band has first and second surfaces. The band is made of a material capable of being formed into a curved shape. A plurality of male snaps are disposed along a first portion of the length of the band. A plurality of female snaps are disposed along a second portion of the length of the band. The second portion is adjacent the first portion. The female snaps mate with the male snaps.

The first and second portions styling accessory comprise at least 95% of the length of the styling accessory. One of the surfaces is finished, and said female snaps extends between the finished surface and the other surface. The female snaps each comprise a cavity configured to matingly engage said male snaps, said cavity being oriented to be disposed on said other surface.

The male snaps of the styling accessory each comprise a protrusion configured to matingly engage said cavity on said female snaps. The protrusions may be oriented to be disposed on said finished surface.

The protrusions may be configured to matingly engage said cavity on said female snaps. the protrusion may be oriented to be disposed on said other surface.

At least one of said surfaces is finished and said female snaps extend between the finished surface and the other surface. The female snaps each comprise a cavity configured to matingly engage said male snaps, said cavity being oriented to be disposed on said other surface.

Optionally, the styling accessory may have at least one of said surfaces is finished. The protrusion is oriented to be disposed on said other surface, and said female snaps extend between the finished surface and the other surface. The female snaps each comprise a cavity configured to matingly engage said male snaps, and said cavity is oriented to be disposed on said other surface. the protrusion on said male snaps configured to matingly engage said cavity on said female snaps, and may be separated by a third portion of the length of said band, and further comprises an additional male snap positioned on said third portion. The additional male snap comprises an additional protrusion mating with a female snap, and said additional protrusion is positioned on said finished surface. The additional male snap is closer to the closest of said female snaps, than it is to the closest of the other male snaps.

The styling accessory may have has a width between 0.5 cm and 7 cm and a length between 80 cm and 120 cm, and the center to center separation between snaps may be between 1.6 to 3.0 cm.

The styling accessory may have a width between 0.5 cm and 7 cm and a length between 80 cm and 120 cm, and the center to center separation between snaps may be 1.8 to 2.9 cm.

Thus snaps, optionally numbering twenty-one male snaps and twenty-one female snaps may be positioned 2.5 cm (one inch) apart from each other.

BRIEF DESCRIPTION OF THE DRAWINGS

The structure and use of the invention will become apparent from the following description taken in conjunction with the drawings, in which:

FIG. 8 illustrates a male snap in the inventive accessory;

FIG. 9 illustrates a female snap;

DETAILED DESCRIPTION OF THE PREFERRED EMBODIMENTS

Figure 2:
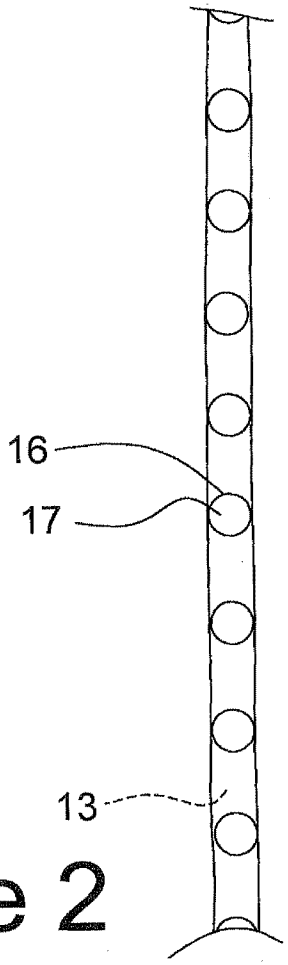
FIGS. 1 and 2 are plan views illustrating different portions of the inventive styling accessory multifunctional adornment.
Figure 1:
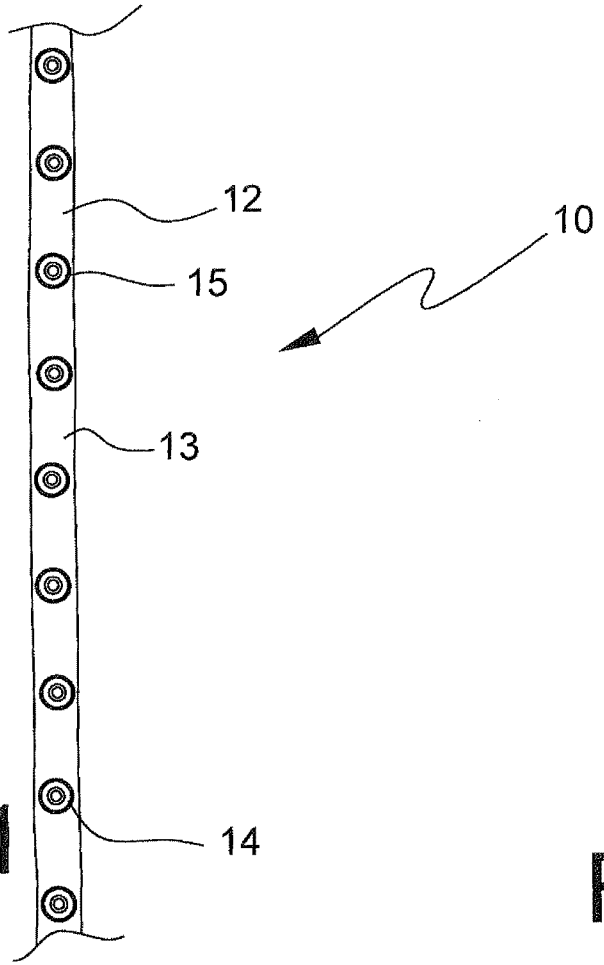

Reference is first made to FIGS. 1 and 2, where it may be seen that in accordance with the present invention, the inventive styling accessory 10 comprises a flexible band 12, which is, optionally, made of leather, such as vat dyed top grain leather sealed with a transparent finish. Alternatively, it may be made of other flexible materials, such as cloth, plastic and/or rubber. While band 12 is shown as a single ply device, it may also comprise multiple layers of the same or different materials. If desired, the multiple layers may be glued to each other (for example to provide two finished top grain leather sides), and/or held to each other by stitching along opposite ends of the width of the band.

Stitching may be made by machine. Alternatively, and more desirably, stitching may be done by prepiercing the leather with holes for receiving the thread, and then lacing the leather together with a first thread end entering one finished side of the band and exiting the other finished side of the band, for example, a band made of two strips of top grain cowhide glued back to back. A second thread end enters the same hole at the other finished side of the band and exits at the said one finished side of the band. The process is continued until one edge of the band is thus stitched. The opposite edge of the band is then secured in the same fashion.

Referring to FIG. 1, flexible band 12 carries a number of male snaps 14, which are made of, optionally, shiny varnished unpainted solid brass in its natural yellow metallic color. Alternatively, snaps 14 can be made of different materials in various colors, for example, brass or tin plated steel, or stainless steel. Alternatively, or additionally, male snaps 14 may be painted a color, for example a color that matches the color of flexible band 12. In accordance with a preferred embodiment of the invention, the center of each male snap 14 is separated by 1.6 to 3.0 cm, most preferably 2 to 2.5 cm from the center(s) of each adjacent snap.

In FIG. 1, the operative female engaging structure 15 is protruding up from the surface of the drawing. Surface 13 may be the unfinished side (or the less finished side of band 12, insofar as in many configurations substantially all of surface 13 or a substantial portion of surface 13 is hidden as it is covered by the underside of that portion of band 12 which carries female snaps 16.

Referring to FIG. 2, in accordance with one preferred embodiment of the invention, the finished side of female snaps 16 takes the form of caps 17. The finish of caps 17 may be shiny brass, stainless or painted, for example with a glossy or matte finish.

As an alternative to individual metal snaps mounted on a leather band, the engagement structure may take the form of an integrally molded, for example a single plastic injection molded part comprising a band, female engagement structure and male engagement structure. The male engagement structure may take the form of male engagement knobs having the same operative structure (knob and waist) as a conventional brass snap.

The snaps are applied in conventional fashion, for example using a template to assure uniform or other desired spacing between the snaps.

Female engagement structure may take the form of a hole, for example an hourglass shaped hole with a reduced diameter midway between the finished and rough sides of the band to promote engagement with the knob on the male engagement structure. Generally, the widest diameter on the knob of the male engagement structure should be larger than the smallest diameter of the hourglass shape which comprises the operative portion of the female engagement structure. Such integrak structures thus incorporate mating male and female engagement structure found on other items, such as the flexible plastic size adjustment structure in the rear band of some modern baseball caps.

In accordance with one preferred embodiment, there are forty-two snaps, comprising twenty-one male snaps and twenty-one female snaps. The snaps are separated by 2.5 cm, as measured center to center along the length of band 12. The resulting 105 cm length works well over a range of, for example, women's sizes. If wrapped around the waist, the 2.5 cm size adjustment increment works well across a range of, for example, women's waist sizes, due to the compressibility of the body where it contacts the garment.

Conversely, if doubled up to act as a headband or hair band, the doubling of inventive accessory 10 over itself effectively results in size adjustment increments of 1.25 cm. Flexible band 12 has multiple functions of use and may be adjusted in size after being configured to perform the desired function as selected by the wearer according to the wearer's needs and preferences. The provision of a higher degree of resolution in the adjustment of the inventive styling accessory 10 when used as a headband or hair band accommodates the smaller degree of flexibility offered by this part of the body, which is relatively hard and incompressible due to the thinness of the epidermal, dermal and subcutaneous lipid cellular structures of the anatomy in this part of the body and the hair which may tend to be arranged in very compact configurations and be substantially incompressible.

Use for multiple functions by average to large men may be accommodated by 2.8 cm spacing of the snaps on a 105 cm long strap, optionally increased to a width of 2.8 cm. Aesthetic considerations may suggest narrower or even much wider band dimensions, but widths between 0.5 cm and 7 cm and lengths between 80 cm and 120 cm are contemplated by the present invention.

Figure 3:
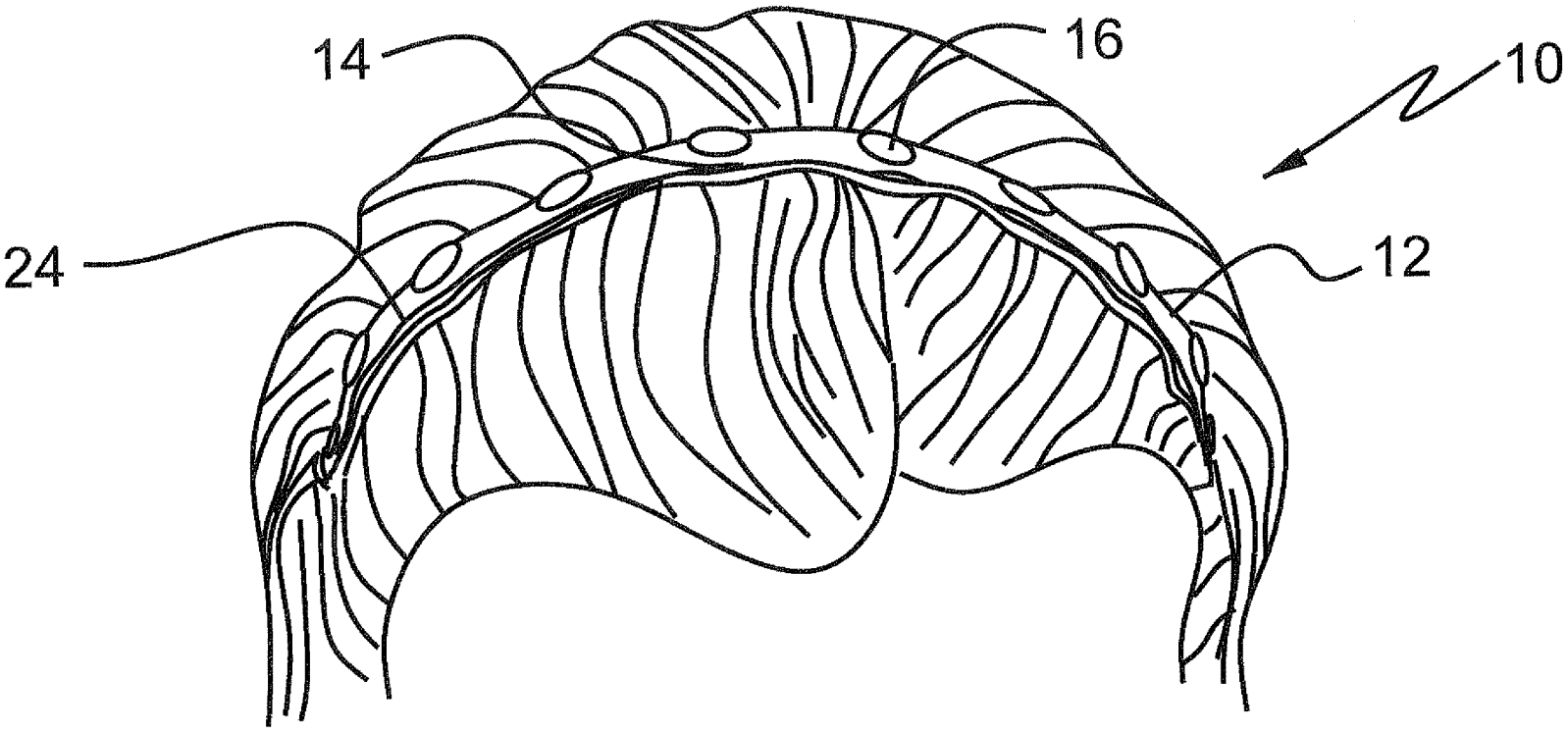
FIG. 3 illustrates the inventive styling accessory configured as hairband in accordance with the present invention and in place around the head of a wearer.

FIG. 3, illustrates the styling accessory 10 with flexible leather band 12 arranged about the hair as a hairband. Arranged on flexible band 12 are the caps 17 of female snap caps 16. Finished face 13 is exposed to view and serves as a top layer of the styling accessory 10 configured as a hairband. Flexible band 12 is configured with, for example, male snaps 14 snapped into the engagement structure 18 of female snaps 16, securely holding the band around a person's head and holding the hair in place, while at the same time becoming a stylish headband adornment 24. The inventive styling accessory can also be worn on a hat in the same configuration as a headband.

Figure 4:
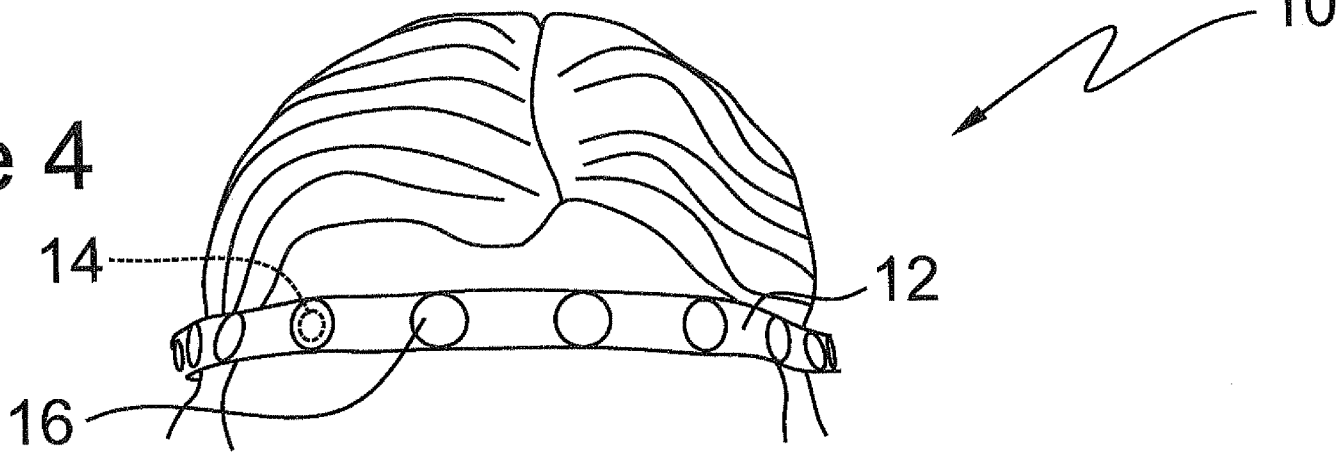
FIG. 4 illustrates the inventive styling accessory utilized as a headband in accordance with the present invention, in place around the forehead of a wearer.

Referring to FIG. 4, the inventive styling accessory 10 has a leather flexible band 12 disposed over the forehead and the back of the head with female snaps 16 in engagement with male snaps 14. The 2.5 cm center to center spacing and the doubling of styling accessory 10 around the forehead allows adjustment to an accuracy of 1.25 cm, thus transforming styling accessory 10 into an attractive headband adornment. Secure positioning of the headband is assured by pairing the female snaps 16 with the appropriate male snaps 14, while the styling accessory is positioned in the desired configuration on a wearer's forehead, and then snapping the male snaps 14 into the female snaps 16. Pairing is done in much the same manner as the prong of a conventional square frame and prong belt buckle is paired with the appropriate hole at the other end of a belt. However, in the case of use as a belt, headband or hairband, it is contemplated that, optionally, many male and female snaps will be in engagement with each other, giving the effect of a single cylindrical leather band.

Figure 5:
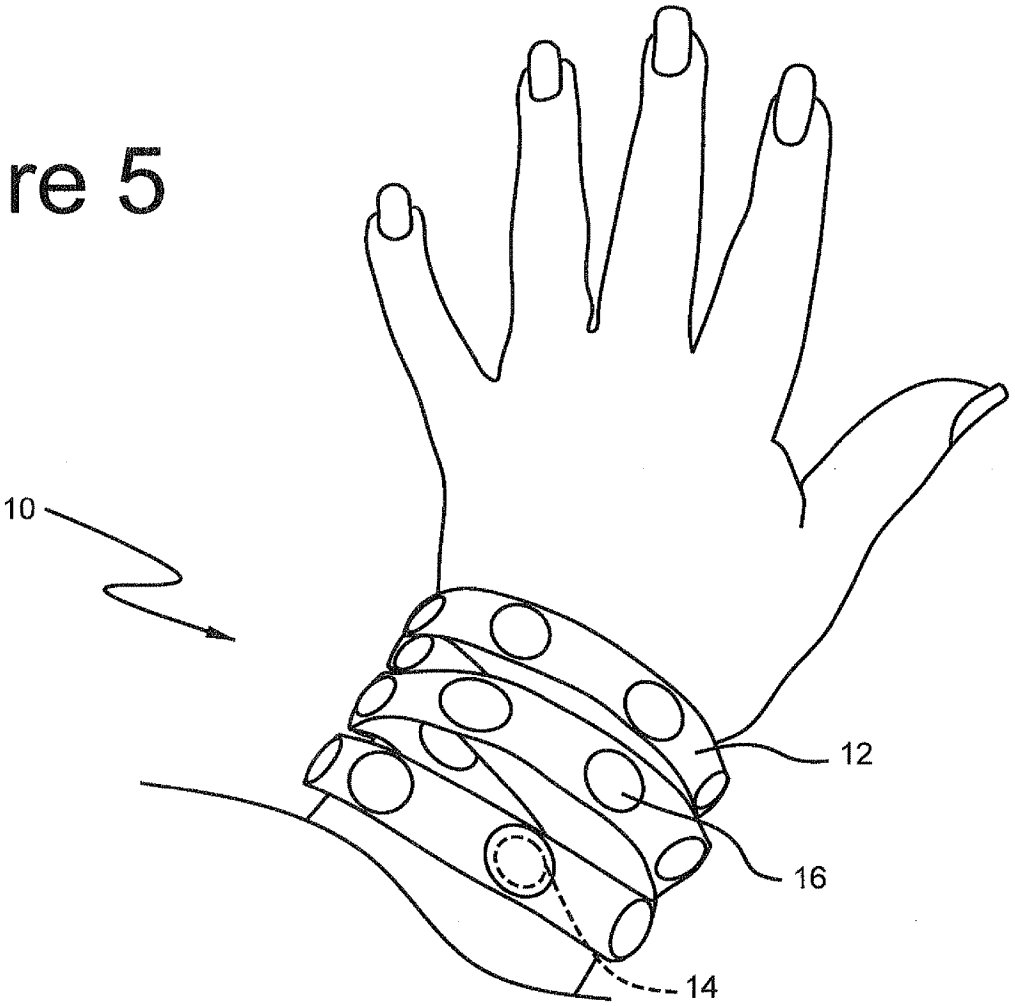
FIG. 5 illustrates the inventive styling accessory utilized as a bracelet, being placed around the wrist of a wearer.

FIG. 5 illustrates styling accessory 10 in use as a bracelet with flexible band 12 in wound many times around the user's wrist. In this configuration, only a single pair of snaps need be snapped into each other, although user choice may suggest configuration using several, if not many snapped snap pairs. The use of the 42 female and male snaps in the center of flexible band 12 2.5 cm apart from each other also provides a quality decorative appearance. The styling accessory 10 is kept in place on the wrist by selecting the appropriate pair or pairs of mating male and female snaps. One may employ one or more layers of styling accessory 10 band over various portions of the wrist, as desired to achieve a particular aesthetic or protective effect.

Figure 6:
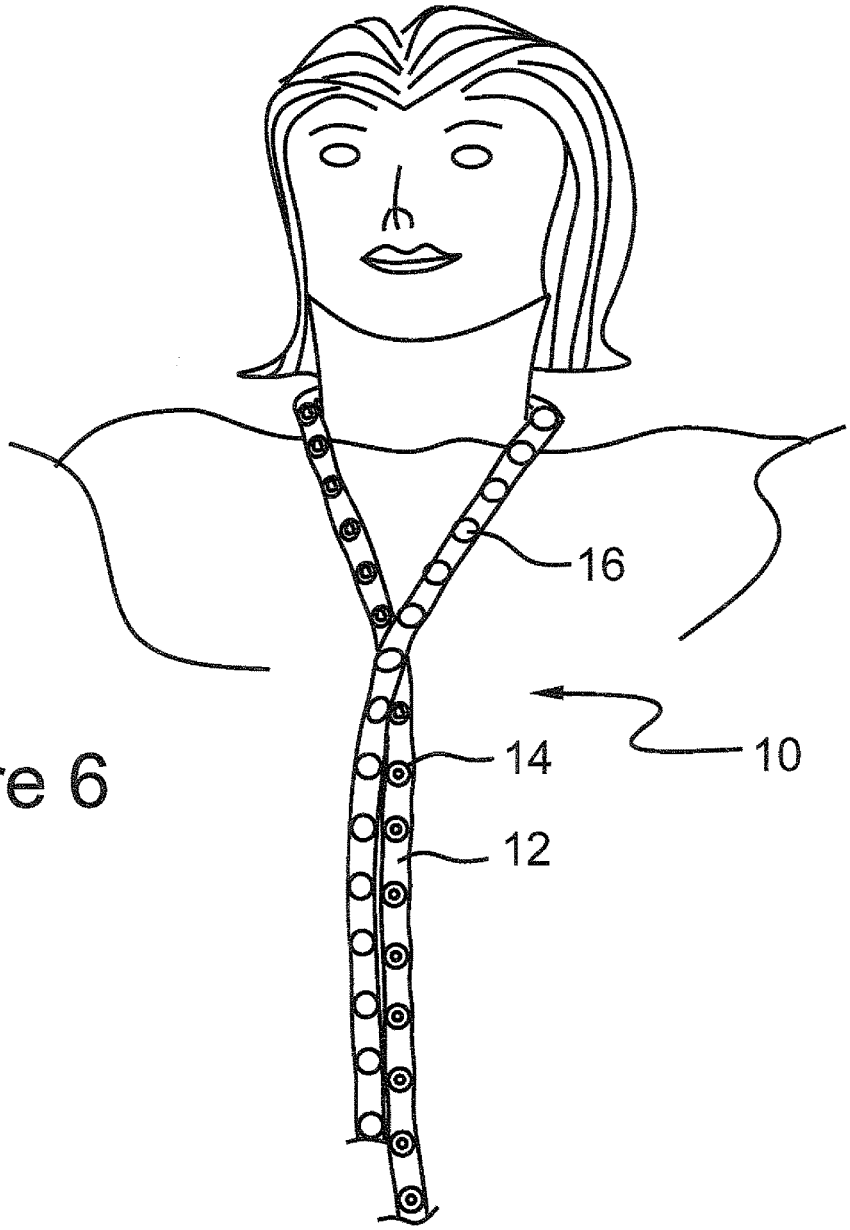
FIG. 6 illustrates the inventive styling accessory being utilized as a necklace, being placed around the neck of a wearer.

FIG. 6 illustrates another alternative adornment that can be formed from inventive styling accessory 10.

To create a necklace flexible band 12 goes over a user's shoulder, behind and around the neck, over the other shoulder, and across the other end of flexible band 12. Styling accessory 10 can be secured by strapping one or more female and male snaps together, perhaps looping the band over itself to achieve a desired ornamental or weighting effect.

Figure 7:
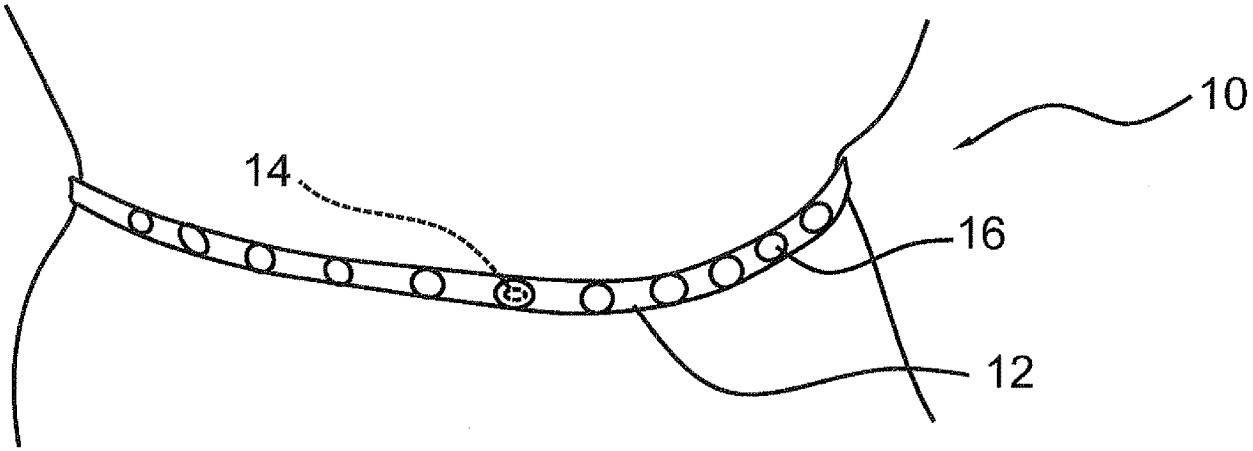
FIG. 7 illustrates the inventive styling accessory while being utilized as a belt, being in place around the waist of a wearer.

FIG. 7 illustrates still another alternative arrangement of the inventive styling accessory 10 with flexible band 12 extending around a user's waist. Styling accessory 10 may be adjusted as detailed above around the user's waist to secure the same and be prevented from falling down off the waist.

To create a belt adornment the flexible band 12, in much the same manner as a conventional belt is positioned around the user's waist and is snapped in position.

Referring to FIG. 8, the structure of male snap 14 is illustrated. A backer 24 comprises a base 26 and a stem 28. The tip 30 of stem 28 is deformed to engage inner surface 32 of knob 15 in order to be securely held in position in the conventional manner.

Referring to FIG. 9, the structure of female snap 16 is illustrated. A cap 17 comprises a knob receiving housing 40 which engages knob 15 with a pair of resilient spring wire ends 42, in a conventional manner. The tip 46 of stem 44 is deformed to engage inwardly curled structure 48 of cap 17, and is securely held in position in the conventional manner.

Figure 10:
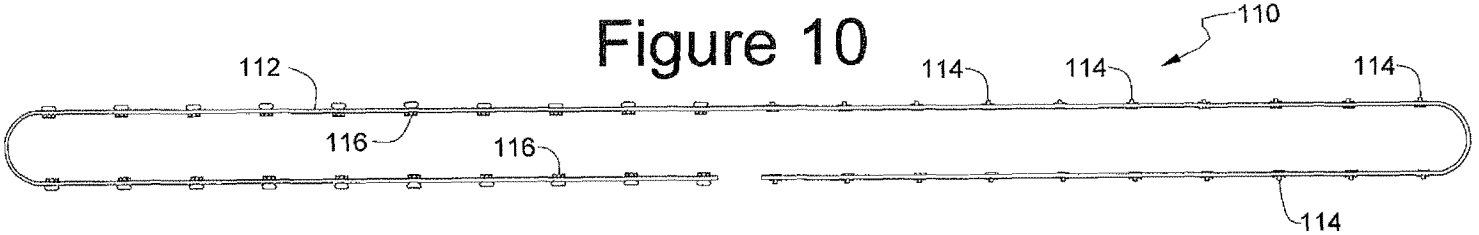
FIG. 10 illustrates an embodiment of the invention with male and female structure on opposite sides.

FIG. 10 is a side view of a styling accessory 110 having 20 male snaps 114 and twenty female snaps 116. The male and female snaps have their engagement structures on opposite sides on the band 112, allowing the formation of a cylindrical belt shape.

Figure 11:
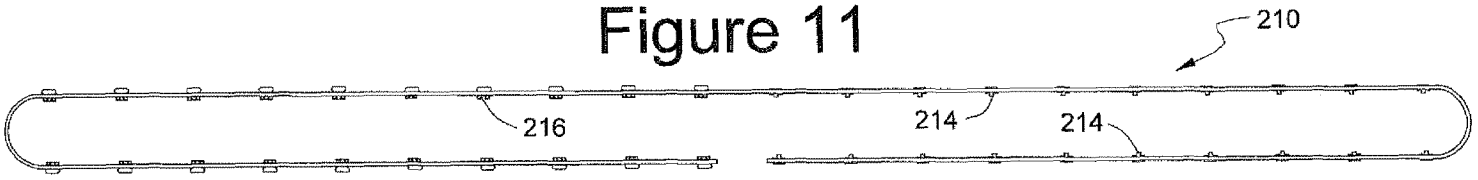
FIG. 11 illustrates an embodiment of the invention with male and female snaps on the same side.

FIG. 11 is a side view of a styling accessory 210 having twenty male snaps 214 and twenty female snaps 216. The male and female snaps have their engagement structures on the same side of the band 212, allowing the folding of the band 212 upon itself.

Figure 12:
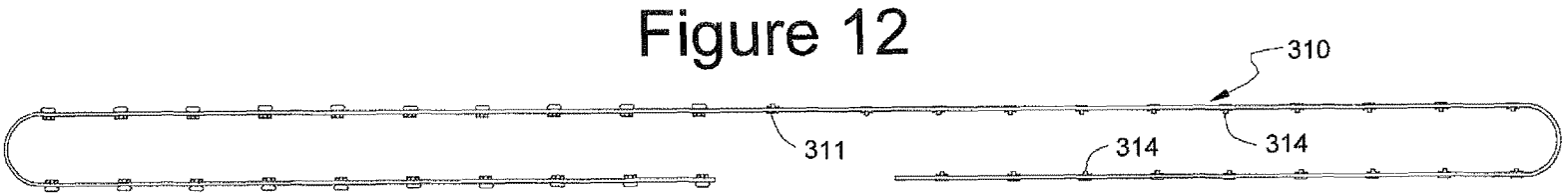
FIG. 12 illustrates an embodiment of the invention adapted to be doubled over and positioned around the waist of a user.
Figure 13:
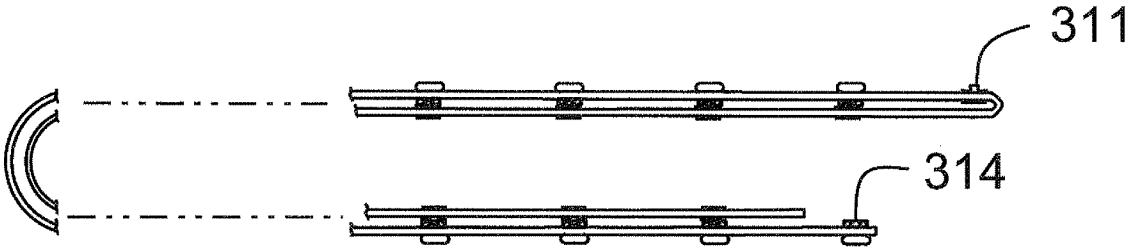
FIG. 13 illustrates orientation of the inventive styling accessory of FIG. 12 after being folded on itself.
Figure 14:
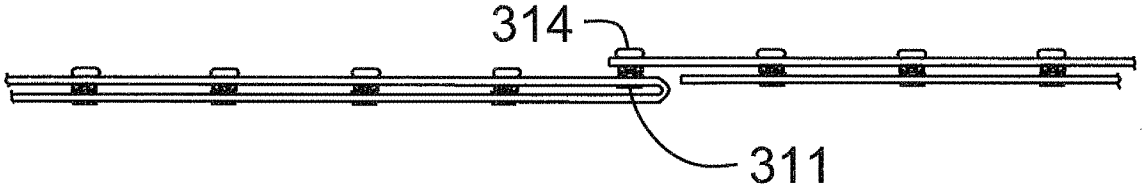
FIG. 14 illustrates the inventive styling accessory after being folded on itself and snap in position.

FIG. 12 shows a styling accessory 310 similar to accessory 210, except that it has only nineteen male snaps 312 with their engagement structure on its unfinished side and a single male snap 311 on its finished side. Accessory 310 my be folded upon itself as illustrated in FIG. 13. A loop may then be formed from the doubled band by engaging male snap 311 with a female snap, for example female snap 314 as illustrated in FIG. 14.

Figure 15:
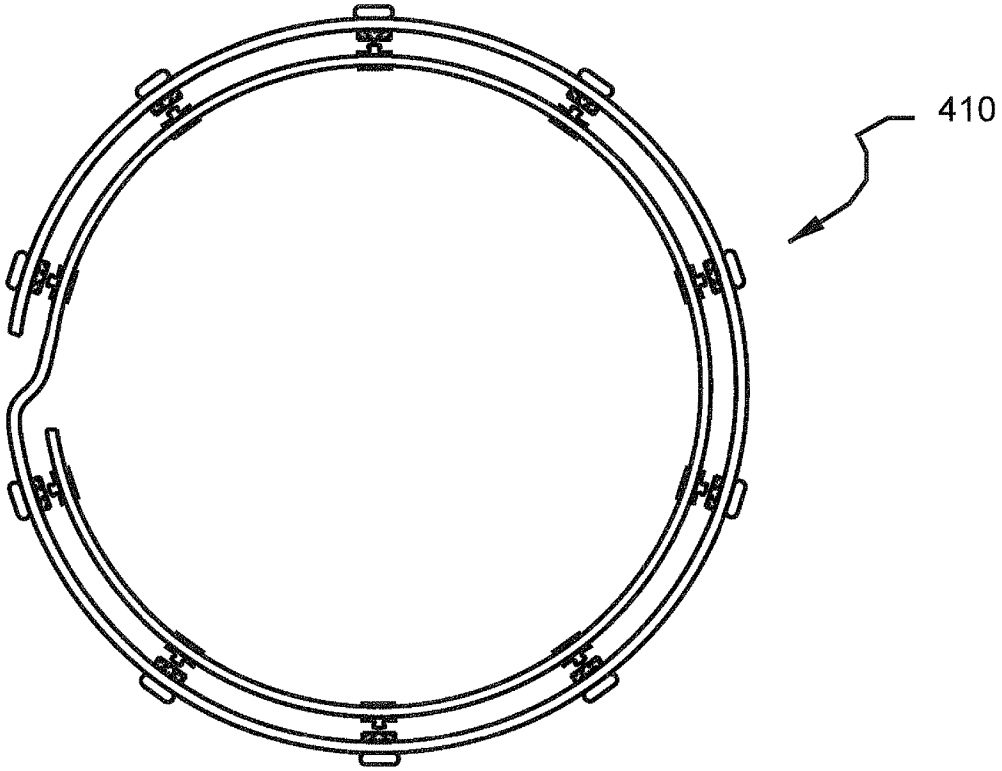
FIG. 15 illustrates one embodiment of the inventive styling accessory configured to be placed around the waist of a wearer.

Inventive styling accessory 410 illustrated in FIG. 15 is similar to accessory 110, except that it has only about twenty snaps, ten male and ten female allowing the formation of a simple band. The snaps are not shown in the engaged position for clarity of illustration.

Figure 16:
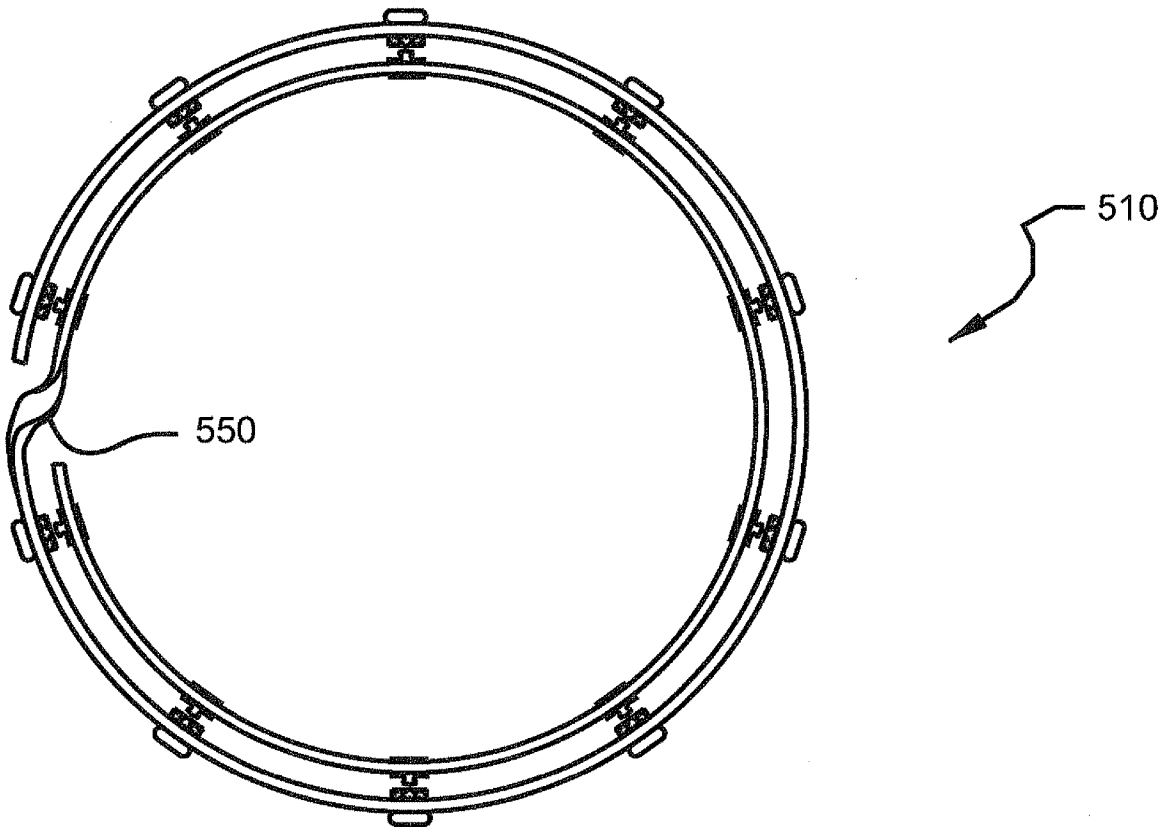
FIG. 16 illustrates another embodiment of the inventive styling accessory configured to be placed around the waist of a wearer.

Inventive styling accessory 510 illustrated in FIG. 16 is similar to accessory 210, except that it has only about twenty snaps, ten male and ten female allowing the formation of a simple band only by introducing a twist 550.

While a number of illustrative embodiments of the inventive caddy have been described above, it is recognized that certain modifications will be obvious to those of ordinary skill in the art. For example, any sizing variation that contains the same components of snaps (ex: equal distanced, equal numbered male and female snaps). For example, one may increase, for example double, the size of the styling accessory to about 200 cm, or reduce the size, for example by one-half the size at disclosed. Such modifications are within the spirit and scope of the invention which is limited and defined only by the appended claims.

What is claimed is:

1. A styling accessory adapted to be configured into different configurations for performing different corresponding functions, comprising:

(a) a band having a width between 0.5 cm and 7 cm and a length between 80 cm and 120 cm, said band having first and second surfaces, said band being made of a material capable of being formed into a curved shape;

(b) a plurality of first coupling members having a first coupling structure disposed along a first portion of the length of said band, said first coupling members extending from said first surface, said plurality of first coupling members being spaced from one another along the first surface; and (c) a plurality of second coupling members having a second coupling structure disposed along a second portion of the length of said band, said second coupling members extending from said second surface, said second portion being proximate said first portion, said center to center separation between first or second coupling members is between 1.6 to 3.0 cm, said second coupling members having a second coupling structure mating with said first coupling members having said first coupling structure, said first and second coupling members being present in a number sufficient to allow engagements at a plurality of portions between first and second coupling members when said band is wound around a body part one or a plurality of times, said first and second coupling members covering a substantial portion of said band, said plurality of second coupling members being spaced with respect to each other at substantially uniform distances, whereby the shape of said styling accessory on the body is stabilized.

2. A styling accessory as in claim 1, wherein said second coupling members having a second coupling structure each comprising a cavity disposed on said first surface configured to matingly engage said first coupling members having a first coupling structure.

3. A styling accessory as in claim 2, wherein said first coupling members having a first coupling structure each comprise a protrusion configured to matingly engage said cavity on said second coupling members having a second coupling structure, said protrusion being oriented to be disposed on said second surface.

4. A styling accessory as in claim 2, wherein said first and second coupling members extend along at least 95% of the length of the styling accessory.

5. A styling accessory as in claim 1, wherein at least one of said surfaces is finished.

6. A styling accessory as in claim 1, wherein said band may be wrapped around a body part and permits size adjustments from said first portion of the length of said band to said band's entire length in increments corresponding to either the separation between first coupling members or to the separation between the second coupling members.

7. A styling accessory as in claim 6 wherein said band is long enough to be wound around the body part twice, and said first and second coupling members are disposed along the length of the band in a number sufficient to allow adjustment in increments of one half of the distance between adjacent first or second coupling members.

8. A styling accessory adapted to be configured into different configurations for performing different corresponding functions, comprising:

(a) a band having a length and a width, said length being at least ten times said width, said band having first and second surfaces, said band being made of a material capable of being formed into a curved shape;

(b) a plurality of first coupling members having a first coupling structure disposed along a first portion of the length of said band;

(c) a plurality of second coupling members having a second coupling structure disposed along a second portion of the length of said band, said second portion being adjacent said first portion, said second coupling members having a second coupling structure mating with said first coupling members having a first coupling structure;

(d) a third portion of the length of said band separating said first and second portions, wherein said first coupling structures extend from the first surface, said second coupling structures extend from said second surface, and further comprising an additional second coupling structure positioned on said third portion, said additional second coupling structure extending from said first surface, wherein said additional second coupling structure is closer to the closest of said first coupling members having a first coupling structure and said second coupling members having a second coupling structure, than said closest first coupling members having a first coupling structure and said closest second coupling members having a second coupling structure are to the next first coupling member having a first coupling structure and second coupling member having a second coupling structure.

9. A styling accessory adapted to be configured into different configurations for performing different corresponding functions, comprising:

(a) a band having a width between 0.5 cm and 7 cm and a length between 80 cm and 120 cm, said band having first and second surfaces, said band being made of a material capable of being formed into a curved shape;

(b) a plurality of first coupling members having a first coupling structure disposed along a first portion of the length of said band, said first coupling members extending from said first surface, said plurality of first coupling members being spaced from one another along the first surface; and (c) a plurality of second coupling members having a second coupling structure disposed along a second portion of the length of said band, said second coupling members extending from said second surface, said second portion being proximate said first portion, said center to center separation between first or second coupling members is 1.8 to 2.9 cm, said second coupling members having a second coupling structure mating with said first coupling members having said first coupling structure, said first and second coupling members being present in a number sufficient to allow engagements at a plurality of portions between first and second coupling members when said band is wound around a body part one or a plurality of times, said first and second coupling members covering a substantial portion of said band, said plurality of second coupling members being spaced with respect to each other at substantially uniform distances, whereby the shape of said styling accessory on the body is stabilized.

10. A styling accessory adapted to be configured into different configurations for performing different corresponding functions, comprising:

(a) a band having a length and a width, said length being at least ten times said width, said band having first and second surfaces, said band being made of a material capable of being formed into a curved shape;

(b) a plurality of first coupling members having a first coupling structure disposed along a first portion of the length of said band;

(c) a plurality of second coupling members having a second coupling structure disposed along a second portion of the length of said band, said second portion being adjacent said first portion, said second coupling members having a second coupling structure mating with said first coupling members having a first coupling structure;

d) a third portion of the length of said band separating said first and second portions comprising an additional first coupling member having a first coupling structure, wherein said additional first coupling member having a first coupling structure is closer to the closest of said first coupling members having a first coupling structure and said second coupling members having a second coupling structure, than said closest first coupling members having a first coupling structure and said closest second coupling members having a second coupling structure are to the next first coupling member having a first coupling structure and second coupling member having a second coupling structure.

11. A styling accessory as in claim 10, wherein said additional coupling member is a first coupling member having a first coupling structure.

12. A styling accessory as in claim 10, wherein said additional coupling member is a second coupling member having a second coupling structure.

* * * * *